United States Patent [19]

Goldman

[11] 4,175,296

[45] Nov. 27, 1979

[54] VARIABLE CONTROL FOR TOILET FLUSH TANKS

[76] Inventor: Harley R. Goldman, 417 Roslyn Rd., Roslyn Heights, N.Y. 11577

[21] Appl. No.: 840,573

[22] Filed: Oct. 11, 1977

[51] Int. Cl.[2] ..... E03D 1/14; E03D 1/34; E03D 3/12; F16K 31/28

[52] U.S. Cl. ..... 4/325; 4/326; 4/378; 4/405; 137/413; 137/423; 137/426

[58] Field of Search ..... 4/324–327, 4/355, 364, 366, 367, 378–381, 385, 393, 405, 407, 412, 413, DIG. 1, 392, 345, 395, 396, 394; 137/413, 414, 423, 426

[56] References Cited

U.S. PATENT DOCUMENTS

| | | | |
|---|---|---|---|
| 1,780,810 | 11/1930 | Brown | 4/326 |
| 2,001,390 | 5/1935 | Lester | 4/325 |
| 2,724,838 | 11/1955 | Wirth et al. | 4/325 |
| 2,735,442 | 2/1956 | Kenney | 137/413 |
| 2,741,776 | 4/1956 | Christie et al. | 4/324 |
| 2,838,765 | 6/1958 | Hosking | 4/407 |
| 2,883,675 | 4/1959 | Hartman, Jr. | 4/324 |
| 3,005,206 | 10/1961 | Dollinger | 4/327 |
| 3,320,622 | 5/1967 | Wustner | 4/325 |
| 3,365,730 | 1/1968 | Chiappetta | 4/325 |
| 3,590,395 | 7/1971 | Wustner | 4/324 |
| 3,733,618 | 5/1973 | Wiegand | 4/393 |
| 3,744,064 | 7/1973 | Preston | 4/325 |
| 4,025,968 | 5/1977 | Davis | 4/DIG. 1 |
| 4,044,407 | 8/1977 | Silcox | 4/364 X |
| 4,056,856 | 11/1977 | Reid et al. | 4/326 |
| 4,057,076 | 11/1977 | Varis | 137/413 |
| 4,115,880 | 9/1978 | Gruenhagen | 4/325 |

*Primary Examiner*—Stuart S. Levy

[57] ABSTRACT

For use in a toilet flush tank having a flush discharge opening at the bottom which is normally closed by a discharge valve having an air chamber therein, an attachment including an air passage for venting the air chamber and a water level responsive valve normally closing the air passage when the water within the tank is above a predetermined height and for venting the air chamber when the water in the tank falls to a predetermined level, so that when the discharge valve is lifted and buoyed by the air within the chamber thereof during the discharge of water from the tank, the discharge valve will be permitted to reseat as soon as the float controlled valve vents the air chamber.

9 Claims, 8 Drawing Figures

VARIABLE CONTROL FOR TOILET FLUSH TANKS

This invention relates to water saving toilet flush tanks, and more particularly to a variable flush control apparatus which is readily adapted for installation in a conventional flush tank to provide for easy adjustment of the level or levels at which the tank discharge valve will reseat to limit the quantity of water discharged during each flush.

Conventional flush tanks now in general use discharge the entire amount of water stored in the tank upon each flushing operation even though only a fraction of that quantity of water may be required for flushing the waste material. This results in unnecessary water consumption, increased water costs and presents special problems where the water is flushed into a cesspool or septic tank. In many places there is a critical shortage of water, and this waste contributes significantly to the shortage. In addition, many municipal waste disposal systems are already overburdened with the increasing quantities of sewerage water that flows through the sewer systems and treatment plants.

It has long been recognized that substantial water saving can be achieved by the provision of a variable flushing control for varying the quantity of water utilized in flushing in accordance with the quantity and character of the waste material to be flushed. Toward this end, various water saving flush tanks and variable flushing control devices have been heretofore proposed.

One type of flush tank heretofore proposed includes a partitioned tank, separate water discharging devices and duplication of plumbing for discharging water from one or both parts of the partitioned tank. In another type, the discharge of water from the tank is controlled by two columns in end-to-end relationship with provision for lifting the upper column for a partial flush and both columns for a full flush. Other types proposed have utilized variable flushing control devices, such as the variable flushing control device described in the prior art Christie et al., U.S. Pat. No. 2,741,776 in which a tube supporting a ball-type discharge valve has a positively actuated valve at the upper end thereof to partially exhaust air from an air chamber within the ball valve when the ball valve is lifted to bring the valve into contact with an actuating bar. The partial evacuation of the air from the ball valve permits gradual reseating of the ball valve upon release thereof. In general, these previously suggested prior art proposals have embodied complicated and expensive structures and are not adapted for use in conventional flush tanks now in use.

The present invention provides a novel variable flush control apparatus for regulating the amount of water flushed from the tank which may be readily attached to a conventional flush tank mechanism. These flush tank mechanisms generally employ a discharge valve of the type which accommodates an air chamber therein open at the bottom to provide buoyancy during the flushing operation. The variable flush control apparatus of the invention embodies an air passage for venting the chamber and a water level responsive valve within the flush tank for maintaining the air passage closed until the water within the tank falls to a predetermined level at which the water level responsive valve is opened to vent the chamber, thereby instantly reseating the discharge valve to prevent further discharge of water from the tank.

In a preferred embodiment of the variable flushing control of the present invention, a plurality of vents and float controlled valves are provided, each adjustable to a predetermined height within the tank. A selector valve is interposed in the air passage from the chamber within the discharge valve to the plurality of vents. Upon operation of the appropriate flushing actuator, the selector valve is automatically set to select the operative vent and float controlled valve associated therewith and at the same time to lift the discharge valve and initiate the discharge of water from the tank. When the water in the tank falls to the level at which the float controlled valve opens, the venting of the chamber reseats the discharge valve and stops the further discharge of water from the tank.

For a full understanding of the present invention, reference should be made to the detailed description which follows and to the accompanying drawings, in which.

Figure 1:
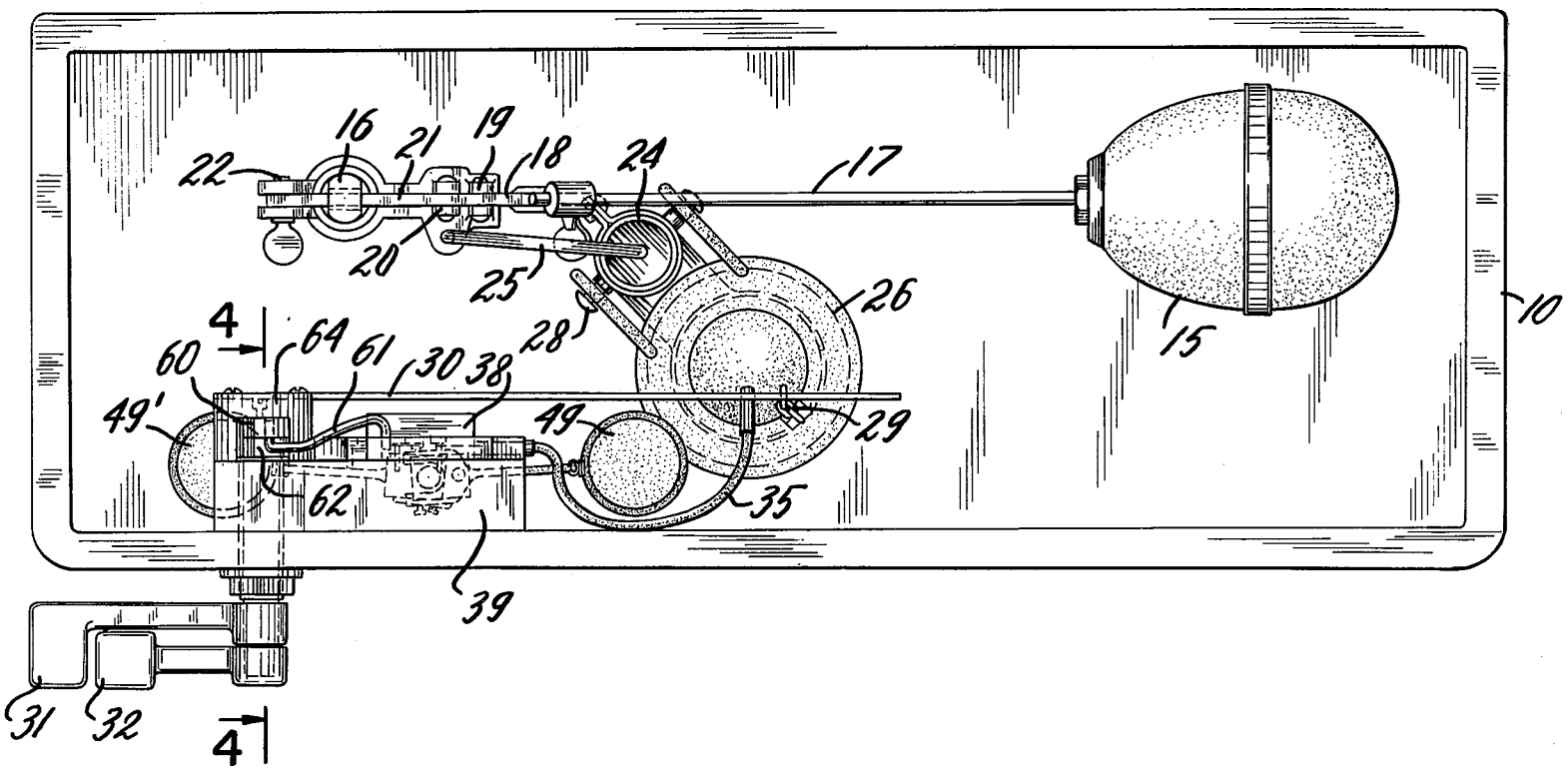
FIG. 1 is a plan view of a flush tank embodying the present invention.
Figure 2:
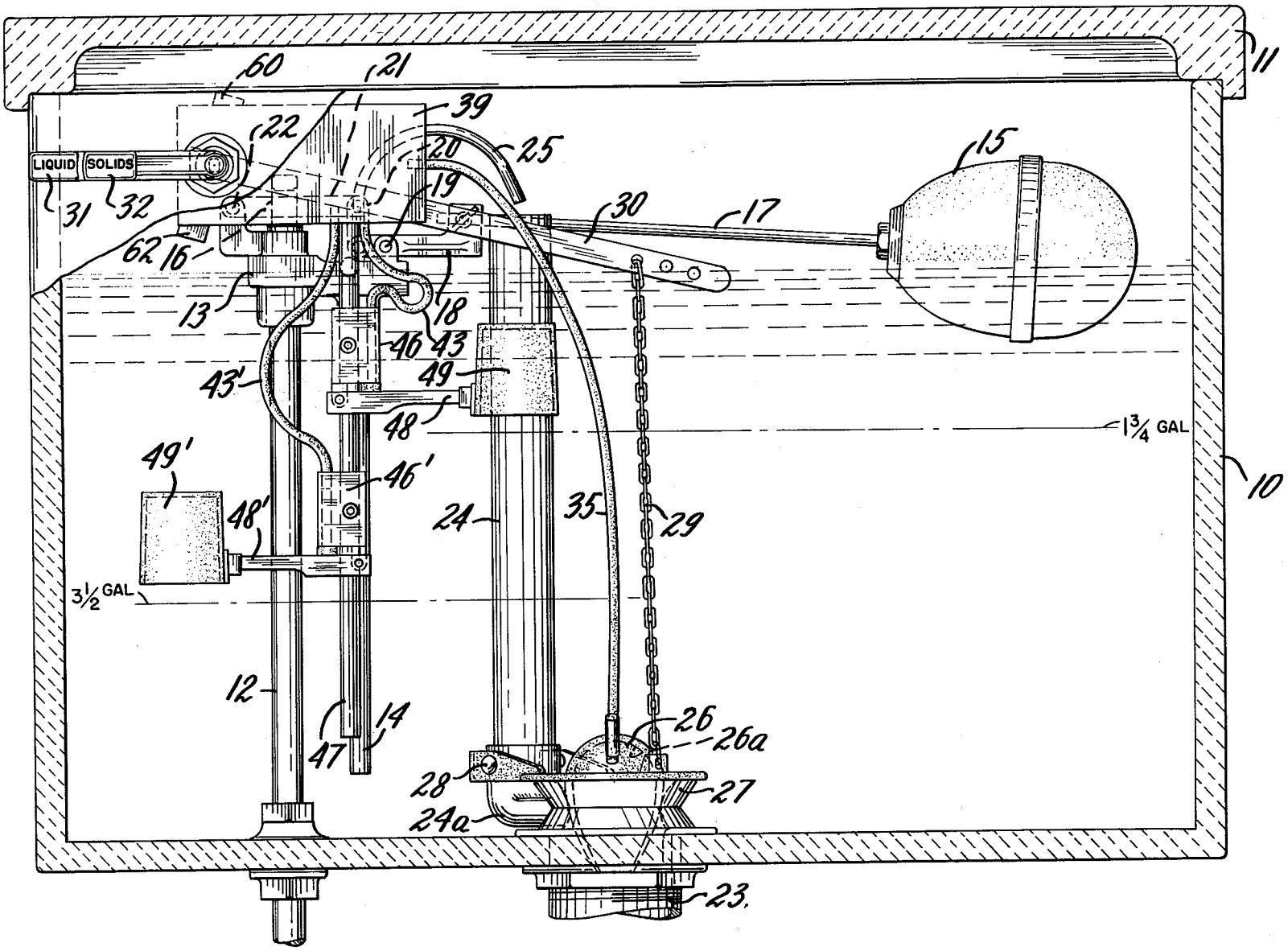
FIG. 2 is an elevational view of the flush tank with part of the front wall of the tank broken away.
Figure 7:
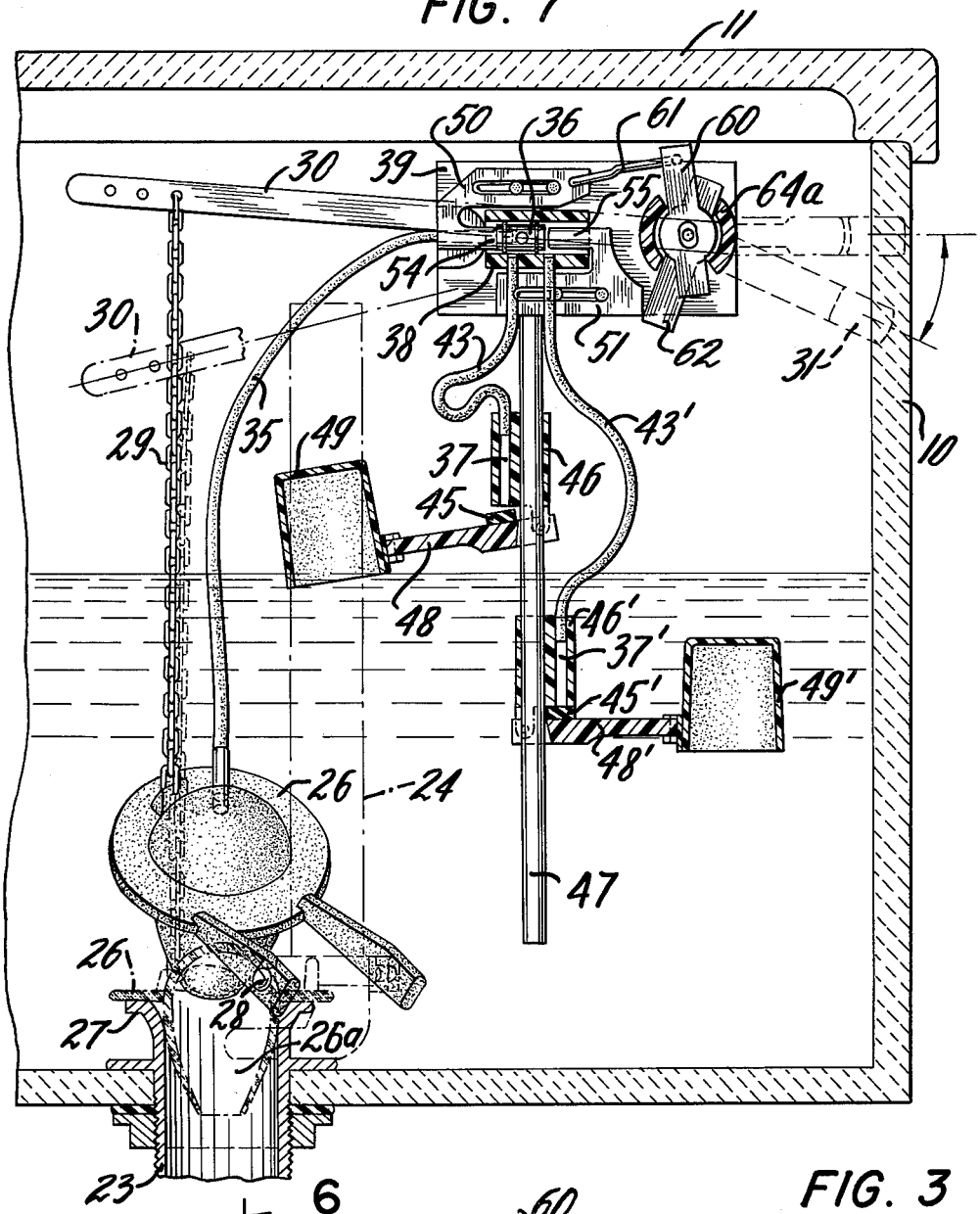
Figure 3:
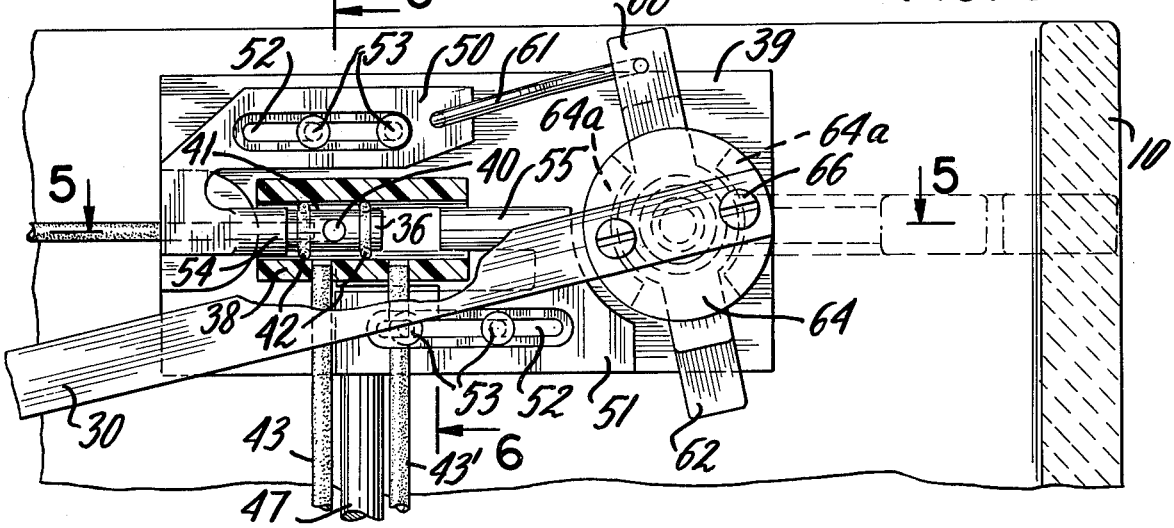
FIG. 3 is an enlarged view of the selector valve and the actuating means therefor.
Figure 6:
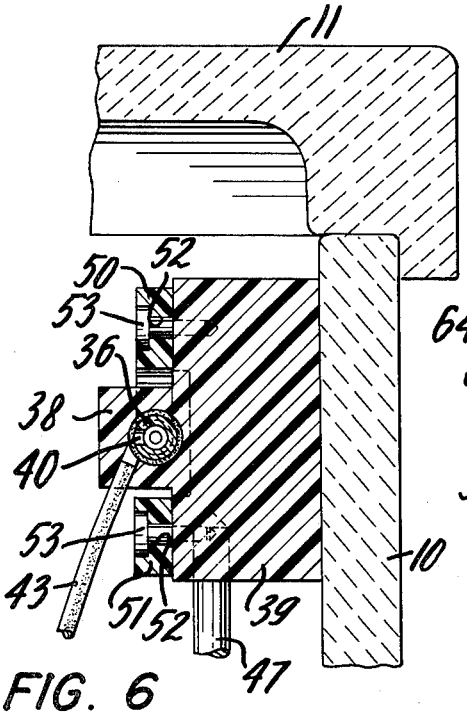
Figure 4:
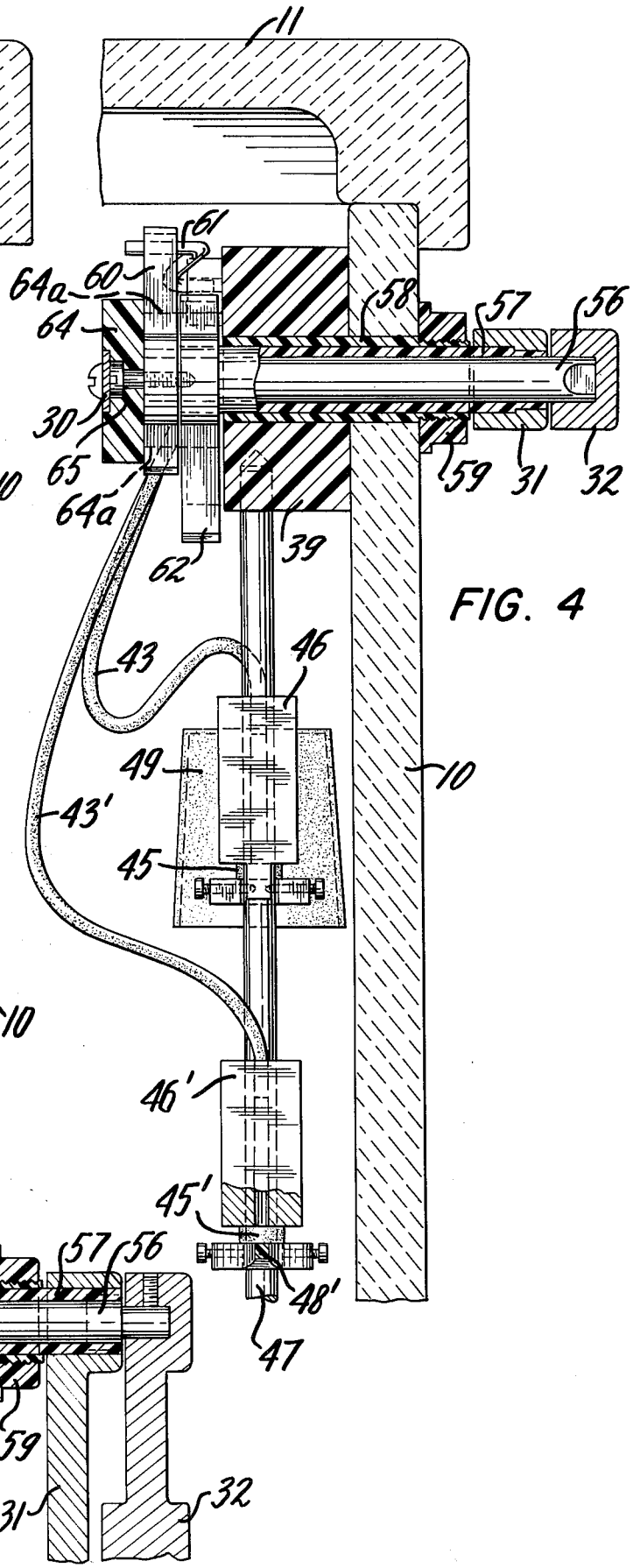
FIG. 4 is a sectional view taken along line 4—4 of FIG. 1 looking in the direction of the arrows.
Figure 5:
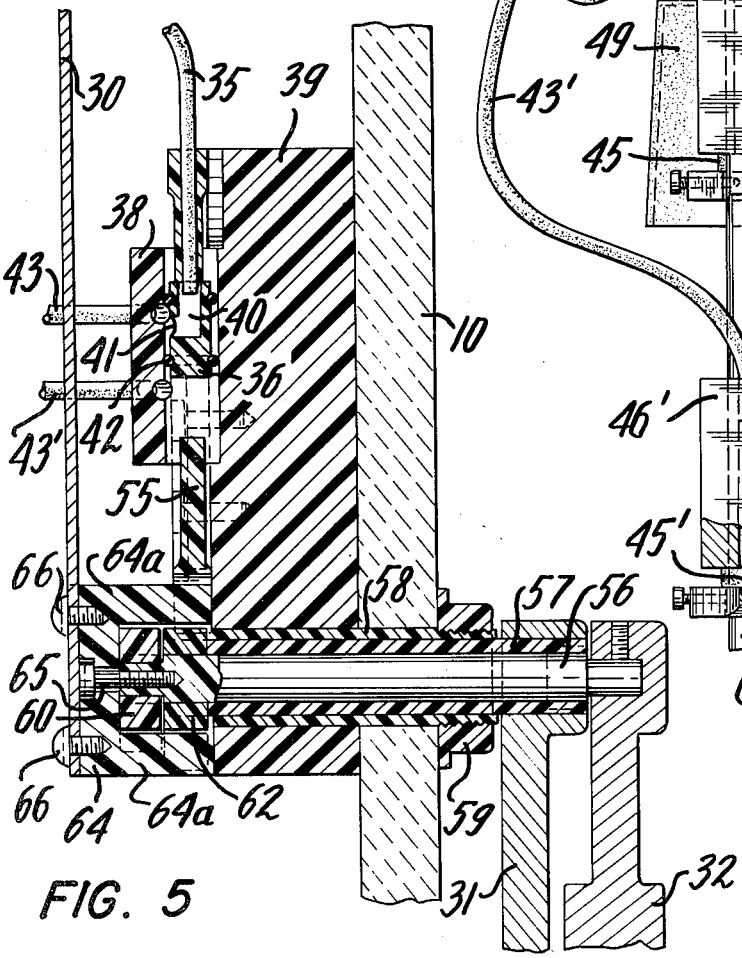
Figure 8:
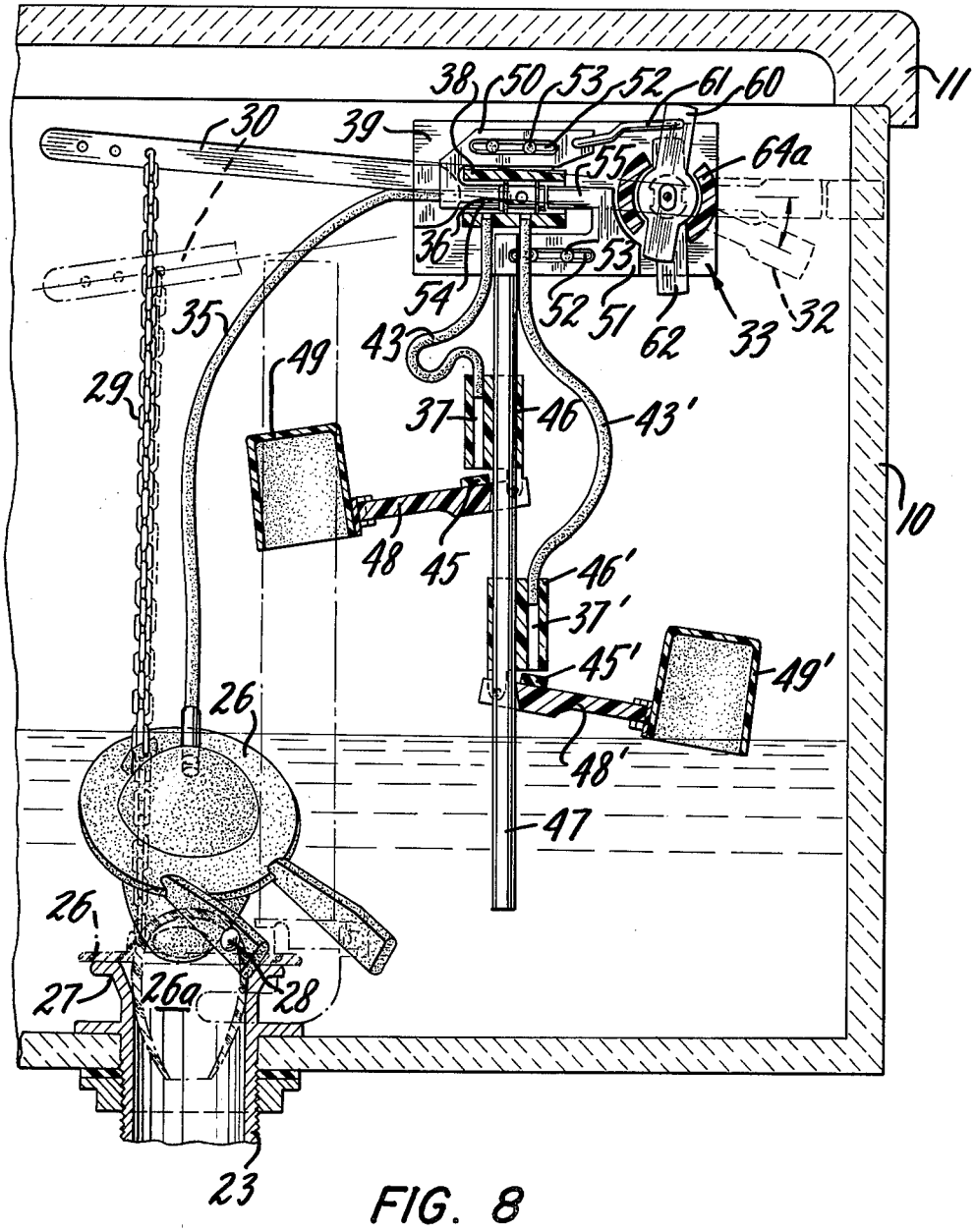

FIGS. 5 and 6 are sectional views taken along the lines 5—5 and 6—6, respectively, of FIG. 3 looking in the direction of the arrows;

FIG. 7 is an elevational view of part of the flush tank with certain of the parts shown in cross-section and illustrating the operation of the parts for a smaller flush of water;

FIG. 8 is a view similar to FIG. 7 and illustrating the operation of the parts for a larger flush of water.

The drawings show a conventional flush tank 10 having a cover 11 and containing the control apparatus of the present invention for regulating the amount of water flushed from the tank installed in conjunction with the conventional flushing apparatus.

The flush tank contains a water supply conduit 12 having a valve housing 13 at the upper end containing a valve through which water is discharged into the tank through a fill pipe 14. The valve is controlled in the usual way by a float 15. The float 15 is connected to the actuator 16 of the valve through an operating linkage which includes a rod 17, a rocker arm 18 pivotally mounted at 19 to the valve housing and connecting links 20 and 21. The link 21 is pivotally mounted at 22 to the valve housing and the link 20 connects the free end of the link 21 and an end of the rocker arm. The float controlled valve thus admits water to the tank when the float drops below a certain level and shuts off the flow of water to the tank when the float rises back to the level.

The tank contains a discharge conduit 23 at the bottom which communicates with the toilet bowl (not shown) to be flushed. An upright conduit 24 open at the top discharges water from a fill pipe 25 through the discharge conduit 23 to fill the toilet bowl. The discharge conduit 23 is normally closed to prevent discharge of the water from the lower region of the tank, but the elbow **24*a*** at the lower end of the upright conduit by-passes the closure.

The discharge of water from the lower region of the tank is controlled by a pivotal ball-type discharge valve 26 which engages a valve seat 27 surrounding the discharge port. The discharge valve 26 is pivotally mounted at 28 from the elbow 24a. The discharge valve 26 is lifted to discharge water from the tank by a chain 29 connected at its upper end to the free end of a pivotal arm 30. In conventional flush mechanisms, the arm 30 is raised by depressing an actuating handle on the outside of the tank which is coupled through the tank wall to the end of the arm. In accordance with the present invention, the single, conventional flush handle is replaced by a pair of handle actuators 31, 32 mounted on the front wall of the tank and connected to the arm 30 through a lost-motion mechanical linkage 33, as will be described below.

The discharge valve 26 has a hollow interior forming a chamber 26a open at the bottom so that it is in open communication with air in the closed position. When lifted to discharge water from the tank, the flow of water through the discharge port traps air within the chamber and maintains the valve in floating condition until the discharge of water from the tank has been completed, at which time the valve is permitted to reseat and the tank and bowl are then refilled through the fill pipes 14 and 25, respectively. When the water in the tank lifts the float 15 to its valve closing position, the refilling operation is completed.

The variable flush control apparatus of the present invention for regulating the amount of water flushed from the tank includes an apparatus for venting the chamber 26a of the discharge valve 26 at a predetermined level of water in the tank, thereby permitting the discharge valve to seat promptly and prevent the further discharge of water from the tank. Toward this end, means providing an air passage, in the form of a flexible air tube 35 connects the chamber 26a within the discharge valve through a multiposition slide valve 36 with a vent 37 or 37' selected by the position of adjustment of the slide valve. The lower end of the tube 35 may be fitted with a sleeve of hard plastic 35' having a pointed end, which may be simply pushed through the soft rubber of which many conventional discharge valves are made, to complete the connection. Threaded or other types of connectors may be provided as appropriate to suit the material and construction of the discharge valve.

The slide valve 36 is accommodated within a housing 38 of a mounting plate 39 supported adjacent the inner surface of the front wall of the tank. As best shown in FIG. 5, the air tube 35 is connected to the end of the valve 36 and communicates through a passage 40 of the valve to a bore 41 which accommodates the slide valve for movement within the housing. A pair of spaced apart O-rings 42 carried by the slide serve to seal the part of the bore which lies between them. In one position of adjustment of the slide 36, the air tube 35 is in communication with the vent 37 through the air tube 43. In another position of adjustment of the slide valve, the air tube 35 is in communication with the vent 37' through the air tube 43'. The vents 37, 37' are normally closed by water level responsive or float controlled valves 45, 45' when the water level in the tank is sufficiently high.

The vents 37, 37' are formed, respectively, in blocks 46, 46', both slidably adjustable on the same vertical mounting rod 47 which depends into the tank from the mounting plate 39. Each of the blocks 46, 46' can be locked in place by suitable means, such as a set screw engageable with the rod 47. The height of the adjustment will control the level of water in the tank at which the selected vent 37 or 37' will be opened.

The float controlled valves 45, 45' are accommodated, respectively, on arms 48, 48' pivotally mounted to the respective blocks 46, 46'. The ends of the arms carry floats 49, 49' which, when the water is sufficiently high, are buoyed upwardly to pivot the respective float controlled valves to closed positions. When the water in the tank falls below a predetermined level at which the float controlled valve of the selected vent is opened, the venting of the chamber 26a of the discharge valve instantly drops the discharge valve to seated position to close the discharge port.

The selection of the operative vent 37 or 37' is controlled by the position of adjustment of the selector valve 36, and the position of the selector valve 36, in turn, is controlled by which of the actuator handles 31 or 32 the person flushing the tank selected. The actuator handle 31 provides a lesser quantity flush for liquid waste, and the actuator handle 32 provides a greater quantity flush for solid waste. The actuator handle 31 displaces the slide valve to the position shown in FIG. 7 to connect the vent 37 with the chamber 26a of the discharge valve, and the actuator handle 32 displaces the slide valve to the position shown in FIG. 8 to connect the vent 37' with the chamber 26a of the discharge valve.

The mounting plate 39 carries a pair of laterally adjustable slides 50, 51, each having a lateral slot 52 formed therein and guided for lateral movement on a pair of pins 53 carried by the mounting plate. The upper slide 50 has an operating arm 54 which is connected with one end of the slide valve 36, and the lower slide 51 has an operating arm 55 which is engageable with the opposite end of the slide valve. The displacement of the upper slide 50 the right, as viewed in FIG. 8, pushes the slide valve 36 to one position of adjustment and the displacement of the lower slide 51 to the left pushes the slide valve to the other position of adjustment.

The slides are operatively connected to the actuator handles 31, 32 through operating components of the lost-motion mechanical linkage 33 and a pair of rotatable shafts 56, 57 coaxially mounted within a tubular support 58 which holds the mounting plate 39 in place on the front wall of the tank. The tubular support projects forwardly through an opening in the front wall of the tank and is threaded to receive a nut 59 which is tightened to lock the mounting plate 39 securely in place.

The actuator handle 31 is mounted on the forward end of the outer shaft 57, and the actuator handle 32 is mounted on the forward end of the inner rotatable shaft 56 which protrudes beyond the end of the outer shaft 57. The rear end of the inner shaft 56 carries thereon a pawl 60 having an upstanding finger which is connected by a link 61 to the upper slide 50. When the shaft 56 is rotated by the depression of the actuator handle 32, the upper slide 50 is pulled by the pawl 60, causing the arm 54 to move the slide valve 36 to the position which renders the vent 37' operative. The rear end of the outer rotatable shaft 57 carries thereon a pawl 62 having a depending finger which engages the lower slide 51. The depression of the actuator handle 31 rotates the pawl 62 into engagement with the lower slide 51, causing the arm 55 carried thereby to push the slide valve to a position which renders the vent 37 operative.

As explained above, the actuator handles 31,32 function through the same lost-motion connection 33 to lift the arm 30 and the chain 29 to unseat the discharge valve 26. Toward this end, a cap 64 having a pair of split ears 64a protruding from one side is rotatably mounted on a screw 65 anchored to the end of the rotatable shaft 56. The outer surface of the head of the cap is slotted to receive the pivotal end of the arm 30 therein, and the arm is anchored to the cap by screws 66. When either actuator handle 31 or 32 is depressed and the corresponding shaft 56 or 57 is rotated, the pawl 60, 62 actuated thereby will engage the ears 64a of the cap, pivoting the cap to lift the arm 30 and unseat the discharge valve 26. Regardless of which pawl, 60 or 62, is the actuator, the cap 64 will be rotated to flush the tank independently of the other pawl and the other actuator handle. The depressed actuator handle 31, 32 is restored to normal raised position when the arm 30 drops after release of the handles as in a conventional flush mechanism.

It is apparent that the blocks 46, 46' can be adjusted on the mounting rod 47 to provide a different quantity of discharge of water from the tank for liquid and solid waste matter. An exemplary setting for the blocks in a six gallon tank would provide a 1¾ gallon discharge for liquid waste and a 3½ gallon discharge for solid waste. Upon operation of the appropriate actuator handle, the slide valve 36 is automatically adjusted to select the appropriate vent 37 or 37'. Also, the discharge valve 26 will be lifted through the linkage 33 irrespective of which actuator handle is depressed. The discharge valve 26 will remain lifted as the water is discharged until the selected vent is vented by the opening of the appropriate float controlled valve 45 or 45'. As soon as the chamber 26a of the discharge valve is vented water will be free to enter the chamber and cause the discharge valve to drop quickly to its reseated position to terminate the flushing operation. If for any reason a full tank discharge is desired, this can be accomplished by holding either actuator handle depressed.

The apparatus can, of course, be utilized with a single actuator handle and a single vent and float controlled valve adjusted to the desired height within the tank. In this case, the normal operation of the handle will partially discharge the tank for flushing liquid waste and the holding of the handle in depressed position will provide a full flush for solid waste.

It will be recognized that installation of the flush control apparatus of the present invention in a conventional flush mechanism does not change the level to which the tank is filled, as established by the float 15 and valve 13, but only the extent to which the tank is emptied during a flush. Thus, maximum water pressure is available for all flush volumes, providing peak flushing effectiveness even with low volume discharges.

The invention has been shown and described in preferred form and by way of example only, and different variations and modifications can be made therein within the spirit of the invention. The invention, therefore, is not intended to be limited to any particular form or embodiment except in so far as such limitations are expressly set forth in the claims.

I claim:

1. For use in a toilet flush tank having a flush discharge opening at the bottom, a discharge valve for closing the discharge opening, a chamber open at the bottom and carried by the discharge valve and means for lifting the discharge valve to flush water from the flush tank through the discharge opening, a flush control apparatus for regulating the amount of water flushed from the tank comprising, a plurality of vents mounted within the flush tank at different heights, a water level responsive valve including float control means normally closing each of said vents when the water in the tank is high enough to buoy said float control means, air passage means adapted to be coupled between the chamber in said discharge valve and said vents, and selector means coupled to said vents and said air passage means for selecting the operative vent, whereby air trapped within the chamber when the discharge valve is unseated retains the discharge valve in floating condition until the water level in the tank falls to a level at which the water level responsive valve associated with the selected vent is opened to vent the entrapped air in said chamber to cause the discharge valve to drop to seated position and close the discharge opening.

2. A flush tank control apparatus as set forth in claim 1 in which the selector means includes a selector valve and further comprising an actuator associated with the vent to be selected, means controlled by the actuator for unseating the discharge valve and means controlled by the actuator for adjusting the selector valve to a position corresponding to the vent to be selected.

3. A flush tank control apparatus as set forth in claim 1, wherein said vents comprise a plurality of elements having vent passages therein, a common support for said elements, means for mounting said elements on said support at vertically adjustable heights, one of said water level responsive valves being associated with each vent passage, said selector means being adjustable to couple said air passage means to a selected vent passage, means connecting each actuator with the selector means so that upon operation of the actuator the selector means is adjusted to couple the selected vent passage to said air passage means, means connecting each said actuator with the discharge valve to unseat it, whereby upon operation of an actuator, water will be discharged from the tank to the level controlled by the opening of the selected vent passage by its associated water level responsive valve, whereupon the discharge valve will be reseated and the tank will be refilled.

4. A flush tank control apparatus as set forth in claim 3 including a mounting in the upper region of the tank for the selector means, a support protruding from the mounting, an opening in the upper region of the front wall of the tank for the protruding support and means engageable with the protruding support for locking the mounting in place.

5. A flush tank control apparatus as set forth in claim 4 including a plurality of coaxially arranged rotatable shafts accommodated for rotation in the support, actuator handles mounted on each shaft outside the tank, and means connecting each rotatable shaft with the selector means to adjust it to a vent selecting position.

6. A flush tank control apparatus as set forth in claim 5 including a lost-motion connection coupled to each of said rotatable shafts to initiate the operation of the discharge valve actuating means by one rotatable shaft independently of another rotatable shaft.

7. A flush tank control apparatus for regulating the amount of water flushed from a tank equipped with a flushing apparatus utilizing a discharge valve having an air-entrapping chamber which retains the valve in a floating condition after being unseated to initiate a flushing operation, comprising an air passage adapted to be coupled to the chamber of said discharge valve, a pair of vent means in said tank adapted to be coupled to said air passage, a float controlled valve associated with each of said vent means and normally closing each vent means when the water in the tank is high enough to buoy said float controlled valve, adjustable means for mounting said float controlled valves at preselected different heights within said tank, and selector means mounted within said tank and interposed between said air passage and said pair of vent means for selecting the operative vent means so that only the opening of the float controlled valve associated with the selected vent means will cause seating of the discharge valve from its floating condition during flushing when the water level within the tank recedes below the level at which buoyancy is provided to the float controlled valve.

8. For use in a toilet flush tank having a discharge opening at the bottom, a discharge valve for closing the discharge opening, said discharge valve having a chamber open at the bottom, and means for lifting the discharge valve to flush water from the flush tank through the discharge opening, a flush control apparatus for regulating the amount of water discharged from the tank in a flush operation comprising:

a plurality of water level responsive valves adapted to respond to respective different predetermined water levels in the tank above said discharge opening, each of said water level responsive valves including a float for controlling its operation;

a like plurality of vent means in said tank respectively adapted to be opened and closed by said water level responsive valves;

air passage means adapted to be coupled to the chamber of said discharge valve and to said vent means;

means for movably mounting each of said water level responsive valves relative to its associated vent means so that the buoyancy of the water within the tank will maintain the valve in its vent closing position until the water level falls below its respective predetermined water level; and selector means for selecting the vent means to be operative in a flush operation, thereby to determine the amount of water discharged from the tank during said flush operation.

9. A flush control apparatus as set forth in claim 8 further comprising means for adjustably mounting each of said floats to vary said predetermined levels.

* * * * *

UNITED STATES PATENT AND TRADEMARK OFFICE

CERTIFICATE OF CORRECTION

PATENT NO. : 4,175,296

DATED : Nov. 27, 1979

INVENTOR(S) : Goldman

It is certified that error appears in the above-identified patent and that said Letters Patent are hereby corrected as shown below:

Col. 6, line 37, before "means" insert --an actuator associated with each vent passage,--.

Signed and Sealed this

Tenth Day of June 1980

[SEAL]

Attest:

SIDNEY A. DIAMOND

Attesting Officer

Commissioner of Patents and Trademarks